US005464678A

United States Patent [19]

Mudge et al.

[11] Patent Number: 5,464,678

[45] Date of Patent: Nov. 7, 1995

[54] FIBERS CONTAINING AN ANTISTATIC FINISH AND PROCESS THEREFOR

[75] Inventors: Elbert H. Mudge, Charlotte; Charles G. DeWitt, Matthews, both of N.C.

[73] Assignee: Henkel Corporation, Plymouth Meeting, Pa.

[21] Appl. No.: 213,769

[22] Filed: Mar. 16, 1994

Related U.S. Application Data

[63] Continuation-in-part of Ser. No. 119,084, Nov. 16, 1993.

[51] Int. Cl.[6] ..... B32B 3/02; B06D 3/02

[52] U.S. Cl. ..... 428/96; 427/389.9; 427/393.1; 428/267

[58] Field of Search ..... 252/8.6, 8.7; 427/389.9, 427/393.1, 393.4; 428/96, 267

[56] References Cited

U.S. PATENT DOCUMENTS

| | | | |
|---|---|---|---|
| 4,051,299 | 9/1977 | Steinmiller | 252/8.7 X |
| 4,223,065 | 9/1980 | Amemiya et al. | 428/272 |
| 4,632,767 | 12/1986 | Saiki et al. | 252/8.8 |
| 4,816,336 | 3/1989 | Allou et al. | 252/8.6 X |
| 4,995,884 | 2/1991 | Ross et al. | 252/8.6 X |

FOREIGN PATENT DOCUMENTS

| | | |
|---|---|---|
| 2270364 | 12/1978 | France . |
| 2528258 | 8/1977 | Germany . |
| 1325164 | 8/1973 | United Kingdom . |

OTHER PUBLICATIONS

Abstract: JP 61–207673.
Abstract: JP 53–135000.
Abstract: JP 55–030407.
Chemical Abstract 92:7811y, Aug., 1979.

*Primary Examiner*—Michael Lusignan
*Attorney, Agent, or Firm*—Wayne C. Jaeschke; John E. Drach; Henry E. Millson, Jr.

[57] ABSTRACT

Process for applying an antistatic finish to synthetic fibers having at least 10 denier per filament comprising of steps of applying to the fibers to be treated a composition comprising at least one salt of a phosphate partial ester containing a $C_{12}$ straight chain alkyl group, a lubricant, and an anionic and/or cationic emulsifier; and autoclaving the treated fibers at a temperature in the range of from about 93° to 150° F. The invention also relates to the synthetic fibers so treated.

20 Claims, No Drawings

FIBERS CONTAINING AN ANTISTATIC FINISH AND PROCESS THEREFOR

CROSS-REFERENCE TO RELATED APPLICATIONS

This application is a continuation-in-part of application Ser. No. 08/119,084 filed Nov. 16, 1993, which claims priority of International Application No. PCT/US92/07655, filed Sep. 16, 1992.

BACKGROUND OF THE INVENTION

1. Field of the Invention

This invention relates to a process for applying an antistatic finish to fibers, especially to nylon carpet fibers, and to the fibers so treated.

2. Statement of Related Art

The use of mono- and di- alkyl phosphate salts as components of antistatic finishes for nylon fibers is known to the art.

In DE 2528258 compositions having antistatic and soil releasing properties are disclosed that contain a fluoroalkyl polymer and an alkyl phosphate salt of the formula $$(RO)_bPO(OM)_{3-b}$$

in which R=$C_{6-20}$ alkyl, M=an alkali metal ion, and b =1 or 2.

JP79,107,885 discloses phosphate alkyl ester salts, the alkyl groups of which contain from 1 to 22 carbon atoms, optionally containing ethylene oxide units, as antistatic agents for nylon fibers.

Netherlands application No. 7505229 discloses compositions containing a fluoroalkyl substituted polymer, a nonionic or anionic surfactant, a polyalkylene glycol alkyl ether, a polyvalent metal salt and/or a copolymer of styrene and an acrylate, and a phosphate alkyl ester salt having the formula $$(RO)_bPO(OM)_{3-b}$$

in which R is a $C_{6-20}$ aliphatic residue, M is an alkali metal, and b=1–4.

In prior art compositions and processes, including those disclosed above, in which the compositions contain a mono- or di- alkyl phosphate salt, the compositions are applied to nylon fibers at relatively low temperatures.

DESCRIPTION OF THE INVENTION

Other than in the operating examples, or where otherwise indicated, all numbers expressing quantities of ingredients or reaction conditions used herein are to be understood as modified in all instances by the term "about".

It has now been discovered that when certain mono- and/or di- alkyl phosphate salts are present in antistatic compositions for application to synthetic fibers such as nylon fibers, the synthetic fibers can be subjected to an autoclave step, which step results in highly enhanced antistatic properties without resulting in appreciable decomposition of the applied antistatic composition. Moreover, the autoclaved fibers exhibit a much higher retention of the antistatic composition during subsequent processing steps such as carding, drafting and spinning.

This resistance to autoclaving is quite surprising. No current process for applying an antistatic finish to synthetic fibers such as nylon includes an autoclave step, and antistatic compositions for which autoclaving of fibers treated with them have been tried have decomposed during the autoclave step, i.e. the resulting fibers no longer possessed acceptable antistatic properties.

The present process comprises the steps of

A) applying to synthetic fibers having at least 10 denier per filament a composition containing at least one salt of a phosphate partial ester having one or two straight chain $C_{12}$ alkyl groups, at least one lubricant, and at least one anionic and/or cationic emulsifier, and B) autoclaving the treated fibers from step A at a temperature in the range of from 93° to 150° C.

The composition used in step A of the above process preferably contains from 12 to 40%, preferably from 15 to 37% by weight of the salt of the phosphate partial ester, from 20 to 50%, preferably from 28 to 42% by weight of lubricant, from 10 to 50%, preferably from 25 to 40% by weight of emulsifier, and from 0 to 25% water.

The above percentages by weight are based on the total weight of the composition.

In addition to the above components, small quantities, e.g. from 0.1 to 10% by weight, of one or more additives can also be present, such as antioxidants, biocides, silicone compounds, fluorocarbon wetting agents, etc.

In the above composition, the salt of the phosphate partial ester is one or more esters having the formula

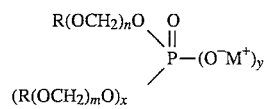

(I)

wherein

R is a straight chain $C_{12}$ alkyl group, i.e. the dodecyl group, $M^+$ is an alkali metal cation, a mono-, di-, or tri-alkyl amine cation, or a mono-, di- or tri-alkanolamine cation, n and m are each independently an integer of from 0 to 6, x is 0 or 1, and y is 2 when x is 0 and 1 when x is 1.

Particularly preferred esters are those wherein n is 0 and x is 0; wherein x is 1 and m and n are both 0; and wherein x is 0 and n is 1–6.

The lubricant or lubricants in the above composition can be selected from a wide variety of heat-stable natural and synthetic oils. For example, paraffin fractions liquid at room temperature such as white oil; animal oils and animal oil derivatives such as glycerol trioleate and hydrogenated tallow glycerides; vegetable oils such as coconut oil, hydrogenated castor oil, and other hydrogenated or partially hydrogenated oils; and other lubricating oils such as tributyl citrate and tridecyl stearate. The choice of lubricant is not critical to the invention, and many other lubricants can be employed in the above composition, provided they are relatively stable under autoclave conditions.

The anionic and/or cationic emulsifiers that can be employed in the above composition can be any anionic or cationic emulsifier that does not significantly decompose under autoclave conditions. Examples of such emulsifiers include relatively long chain alkyl sulfates, sulfosuccinates, and sulfonates. By relatively long chain is meant from 6 to 18 carbon atoms in the alkyl groups. Also included are various polyoxyethylene and/or polyoxypropylene fatty amines, fatty alcohols, fatty acids, and hydrogenated vegetable oils, such as polyoxyethylene tallow amine, polyoxyethylene hydrogenated castor oil, and polyoxyethylene coconut fatty acid. The above polyoxyalkylene compounds can contain from 2 to 25 ethyleneoxy and/or propyleneoxy groups. Here again, the particular anionic or cationic emulsifiers or mixtures of emulsifier or mixture of emulsifiers selected for use in the above composition is not critical to the invention.

The synthetic fibers that can be treated by the present process are those having a rating of 10 DPF (denier per filament) and above, e.g. from 10 DPF to 25 DPF, and include nylon fibers, i.e. where the fiber forming substance is any long chain synthetic polyamide having recurring amide groups (—CONH—) as an integral part of the polymer chain. Examples include but are not limited to nylon 66, nylon 4, nylon 6, nylon 9, nylon 11, and nylon 610. In addition, synthetic polyester fibers can be treated with an antistatic finish by the present process. The present process is particularly useful in applying an antistatic coating to carpets, especially nylon carpets.

The synthetic fibers are treated with the antistatic composition at room temperature, e.g. by spraying or brushing the composition onto the fibers. Generally, from 1.0 to 1.8% by weight, preferably from 1.0 to 1.5% by weight of the composition, based on the weight of the fibers, is applied to the fibers.

The autoclave step is carried out at a temperature in the range of 93° to 150° C., preferably in the range of 110° to 143° C., and more preferably in the range of 135° to 141° C., for a period of from 30 minutes to 90 minutes, preferably from 45 minutes to 75 minutes. An autoclave temperature of 138° C. for 60 minutes has proven particularly useful.

The synthetic fibers treated by the process of the invention exhibit excellent antistatic properties and the antistatic coating has proven to be unusually durable and long lasting, even after repeated cleaning of the fibers.

The invention will be illustrated but not limited by the following examples.

EXAMPLES

Example 1–3

The antistatic finish formulations set forth in Table I were prepared by mixing together the specified ingredients in the percent quantities shown.

The formulations were applied to nylon fibers in the quantities given in Table I.

Static half life results are set forth both before and after autoclaving in Table II.

Autoclaving was carried out by heating the treated nylon fibers to a temperature of 113° C. for from 3–4 minutes, venting and exhausting the autoclave, heating the fibers to 138° C. for 4 minutes followed by venting and exhausting, heating the fibers for 4 minutes at 138° C. followed by venting and exhausting, and finally heating the fibers to 138° C. for 8–12 minutes also followed by venting and exhausting.

The static half life measurements were made by first cutting 25.4 by 63.5 mm test sections of cloth made from the nylon fibers. These test sections were washed in 50/50 by volume isopropyl alcohol/water, rinsed in water, air dried, and each antistatic finish formulation in the form of 1% aqueous emulsion was applied to 8–10 test sections. The resulting test sections were then air dried. Autoclaving was carried out as above for half of the test sections. Antistatic testing was carried out in a Rothschild Static Voltmeter R-3021, manufactured by Rothschild Messinstrumente 8002 Zürich, Switzerland, Traubenstrasse 3, using an applied voltage of 100 volts. The static half life is the time in which the voltage dropped to 50 volts. The test was carried out using 4–5 identical test sections and the results were averaged.

Comparison Examples 1–14

The comparison formulations set forth in Table I were prepared and tested in the same manner as Examples 1–3, and the static half life results are given in Table II.

As can be seen from Table II, the formulations of the invention (Examples 1–3) produced excellent and consistent antistatic properties on nylon fibers, even after autoclaving, while the formulations of the comparison examples (Comparison Examples 1–14) showed either much poorer or inconsistent antistatic properties after autoclaving.

TABLE I

| | Example | | | Comparison | | | | | | | | | | | | | |
|---|---|---|---|---|---|---|---|---|---|---|---|---|---|---|---|---|---|
| | 1 | 2 | 3 | 1 | 2 | 3 | 4 | 5 | 6 | 7 | 8 | 9 | 10 | 11 | 12 | 13 | 14 |
| 76° Coconut Oil | 8.6 | 21.0 | 20.6 | 21.6 | 21.6 | 21.6 | 21.6 | 21.6 | 8.6 | 8.6 | 21.6 | 21.6 | 23.5 | 24.1 | 8.6 | 21.6 | 8.6 |
| Tridecylsterate | 15.2 | 10.3 | 10.3 | 10.8 | 10.8 | 10.8 | 10.8 | 10.8 | 15.2 | 15.2 | 10.8 | 10.8 | 11.8 | 12.0 | 15.2 | 10.8 | 15.2 |
| 210 SUS @ 38° C. Mineral Oil USP | 8.6 | | | | | | | | 8.6 | 8.6 | | | | | 8.6 | | 8.6 |
| Oleic Diethanolamide | 10.6 | 15.2 | 11.9 | 15.2 | 11.9 | 15.2 | 10.6 | 11.9 | 10.6 | 15.2 | 15.2 | 11.9 | 15.2 | 11.9 | 10.6 | 10.6 | 10.6 |
| POE (16) Hydrogenated Castor Oil | 11.4 | 11.4 | 9.0 | 11.4 | 9.0 | 11.4 | 11.4 | 9.0 | 11.4 | 11.4 | 11.4 | 9.0 | 11.4 | 9.0 | 11.4 | 11.4 | 11.4 |
| POE (9) Styrenated Phenol | 9.3 | 13.3 | 10.4 | 13.3 | 10.4 | 13.3 | 9.3 | 10.4 | 9.3 | 13.3 | 13.3 | 10.4 | 13.3 | 10.4 | 9.3 | 9.3 | 9.3 |
| Water | 4.8 | 4.8 | 4.8 | 4.8 | 4.8 | 4.8 | 4.8 | 4.8 | 4.8 | 4.8 | 4.8 | 4.8 | 4.8 | 4.8 | 4.8 | 4.8 | 4.8 |
| Dodecyl Phosphate, K Salt | 31.5 | 24.0 | 33.0 | | | | | | | | | | | | | | 15.7 |
| Tridecyl Phosphate, K Salt | | | | 22.9 | 31.5 | | | | | | | | | | | | |
| POE (3) Tridecyl-phosphate, K Salt | | | | | | 22.9 | 31.5 | 31.5 | 31.5 | 22.9 | | | | | | | 15.8 |
| 2-Ethyl Hexyl Phosphate, K Salt | | | | | | | | | | | 22.9 | 31.5 | | | | | |

TABLE I-continued

| | Example | | | Comparison | | | | | | | | | | | | | |
|---|---|---|---|---|---|---|---|---|---|---|---|---|---|---|---|---|---|
| | 1 | 2 | 3 | 1 | 2 | 3 | 4 | 5 | 6 | 7 | 8 | 9 | 10 | 11 | 12 | 13 | 14 |
| POE (6) Isodecyl Phosphate, K Salt | | | | | | | | | | | | | 20.0 | 27.8 | | | |
| POE (4) Oleyl Phosphate, K Salt | | | | | | | | | | | | | | | 31.5 | 31.5 | |
| Nylon fibers, type 18 DPF | 66 | 6 | 6 | 6 | 6 | 6 | 66 | 6 | 66 | 66 | 6 | 6 | 6 | 6 | 66 | 66 | 66 |
| Quantity applied, wt. % | 1 | 1.5 | 1.5 | 1.5 | 1.5 | 1.5 | 1 | 1.5 | 1 | 1 | 1.5 | 1.5 | 1.5 | 1.5 | 1 | 1 | 1 |

Note: POE followed by a number in parenthesis means the number of oxyethylene groups in the molecule.

TABLE II

| EXAMPLE | PHOSPHATE ESTER* | % | STATIC HALF LIFE, SECONDS BEFORE AUTOCLAVE | STATIC HALF LIFE, SECONDS AFTER AUTOCLAVE |
|---|---|---|---|---|
| 1 | dodecyl, K | 31.5 | 17 | 37 |
| 2 | dodecyl, K | 24.0 | 0.31 | 11 |
| 3 | dodecyl, K | 33.0 | 0.43 | 43 |
| Comp. 1 | tridecyl, K | 22.9 | 1 | >240 |
| Comp. 2 | tridecyl, K | 31.5 | 0.8 | >240 |
| Comp. 3 | POE (3) tridecyl, K | 22.9 | 0.59 | >240 |
| Comp. 4 | POE (3) tridecyl, K | 31.5 | 18 | 120 |
| Comp. 5 | POE (3) tridecyl, K | 31.5 | 0.8 | 157 |
| Comp. 6 | POE (3) tridecyl, K | 31.5 | <1 | 6 |
| Comp. 7 | POE (3) tridecyl, K | 22.9 | 19 | 74 |
| Comp. 8 | 2-ethylhexyl, K | 22.9 | 0.63 | >240 |
| Comp. 9 | 2-ethylhexyl, K | 31.5 | 4.67 | >240 |
| Comp. 10 | POE (6) isodecyl, K | 20.0 | 0.55 | >240 |
| Comp. 11 | POE (6) isodecyl, K | 27.8 | 0.57 | >240 |
| Comp. 12 | POE (4) oleyl, K | 31.5 | 24 | 125 |
| Comp. 13 | POE (4) oleyl, K | 31.5 | 36 | 190 |
| Comp. 14 | 50/50 dodecyl phosphate, K/POE(3) tridecyl phosphate, K | 31.5 | 7 | >240 |
| Untreated Control | — | — | >700 | >240 |

*All esters are mixtures of compounds of formula I wherein x = 0 and x = 1 in a mol ratio of from 50:50 to 65:35.

What is claimed is:

1. A process for applying an antistatic finish to synthetic fibers having at least 10 denier per filament comprising the steps of A) applying to the above fibers a composition comprising a) at least one salt of a phosphate partial ester having one or two straight chain $C_{12}$ alkyl groups, b) at least one lubricant, and c) at least one anionic and/or cationic emulsifier, and B) autoclaving the treated fibers from step A) at a temperature in the range of from about 93° to about 150° C.

2. The process of claim 1 wherein step B) is carried out at a temperature in the range of from about 110° to about 143° C.

3. The process of claim 2 wherein said temperature is from about 135° to about 141° C.

4. The process of claim 1 wherein the synthetic fibers are nylon fibers.

5. The process of claim 1 wherein in step A) a) the at least one salt of a phosphate partial ester is at least one salt of a phosphate partial ester of the formula

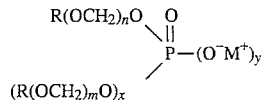

(I)

wherein

R is the dodecyl group, $M^+$ is an alkali metal cation, a mono-, di-, or tri-alkyl amine cation, or a mono-, di- or tri-alkanolamine cation, n and m are each independently an integer of from 0 to 6, x is 0 or 1, and y is 2 when x is 0 and 1 when x is 1.

6. The process of claim 5 wherein a mixture of compounds of formula I are present in which in one compound x=0 and n=0, and in a second compound x=1 and n=0.

7. The process of claim 5 wherein a mixture of compounds of formula I are present in which in one compound x=0 and n=1–6 and in a second compound x=1 and n=1–6.

8. The process of claim 1 wherein in the composition in step A) from about 12 to about 40% by weight of component a), from about 20 to about 50% by weight of component b), from about 10 to about 50% by weight of component c), and from 0 to about 25% by weight of water are present therein.

9. The process of claim 8 wherein from about 15 to about 37% by weight of component a), from about 28 to about 42% by weight of component b), and from about 25 to about 40% by weight of component c) are present therein.

10. The process of claim 1 wherein step B) is carried out for a period of from about 30 to about 90 minutes.

11. The process of claim 10 wherein said period is from about 45 to about 75 minutes.

12. The process of claim 1 wherein in step A) component b) of the composition is at least one of the following: a paraffin fraction, an animal oil, an animal oil derivative, a vegetable oil or a derivative of a vegetable oil or a component of a vegetable oil.

13. The process of claim 1 wherein in step A) a) the at least one salt of a phosphate partial ester is at least one salt of a phosphate partial ester of the formula

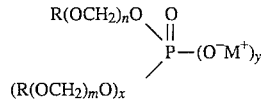

(I)

wherein

R is the dodecyl group, $M^+$ is an alkali metal cation, a mono-, di-, or tri-alkyl amine cation, or a mono-, di- or tri-alkanolamine cation, n and m are each independently an integer of from 0 to 6, x is 0 or 1, and y is 2 when x is 0 and 1 when x is 1;

the composition in step A) comprises from about 12 to about 40% by weight of component a), from about 20 to about 50% by weight of component b), from about 10 to about 50% by weight of component c), from 0 to about 25% by weight of water; and step B) is carried out at a temperature in the range of from about 110° to about 143° C. for a period of from about 30 to about 90 minutes.

14. The process of claim 13 wherein a mixture of compounds of formula I are present in which in one compound x=0 and n=0, and in a second compound x=1 and n=0.

15. The process of claim 13 wherein a mixture of compounds of formula I are present in which in one compound x=0 and n=1–6 and in a second compound x=1 and n=1–6.

16. The process of claim 13 wherein the synthetic fibers are nylon fibers.

17. The process of claim 13 wherein the composition in step A) comprises from about 15 to about 37% by weight of component a), from about 28 to about 42% by weight of component b), and from about 25 to about 40% by weight of component c).

18. The process of claim 17 wherein in step B) the temperature is from about 135° to about 141° C. for a period of from about 45 to about 75 minutes.

19. Synthetic fibers containing an antistatic finish applied by the process of claim 1.

20. Synthetic fibers containing an antistatic finish applied by the process of claim 13.

* * * * *